US011081803B2

(12) United States Patent
Ko et al.

(10) Patent No.: US 11,081,803 B2
(45) Date of Patent: Aug. 3, 2021

(54) INSTRUMENT COMPRISING PLANE LENS ANTENNA AND CONTROL METHOD THEREOF

(71) Applicant: Samsung Electronics Co., Ltd., Suwon-si (KR)

(72) Inventors: Seungtae Ko, Suwon-si (KR); Yoongeon Kim, Suwon-si (KR); Seungku Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 63 days.

(21) Appl. No.: 16/487,344

(22) PCT Filed: Feb. 20, 2018

(86) PCT No.: PCT/KR2018/002057
§ 371 (c)(1),
(2) Date: Aug. 20, 2019

(87) PCT Pub. No.: WO2018/155878
PCT Pub. Date: Aug. 30, 2018

(65) Prior Publication Data

US 2020/0176882 A1 Jun. 4, 2020

(30) Foreign Application Priority Data

Feb. 21, 2017 (KR) ..... 10-2017-0022805

(51) Int. Cl.
*H01Q 19/06* (2006.01)
*H01Q 1/12* (2006.01)
(Continued)

(52) U.S. Cl.
CPC ..... *H01Q 19/06* (2013.01); *H01Q 1/1257* (2013.01); *H01Q 1/246* (2013.01); *H01Q 3/14* (2013.01)

(58) Field of Classification Search
CPC .... H01Q 19/06; H01Q 19/062; H01Q 19/065; H01Q 1/1257; H01Q 1/246; H01Q 3/14; H01Q 15/08; H01Q 15/02
See application file for complete search history.

(56) References Cited

U.S. PATENT DOCUMENTS 6,014,110 A 1/2000 Bridges
6,559,805 B2 * 5/2003 Yamauchi ..... H01Q 3/02 343/765
(Continued)

FOREIGN PATENT DOCUMENTS

CN 103036035 A 4/2013
CN 105009370 A 10/2015
(Continued)

OTHER PUBLICATIONS

Chinese Office Action with English translation dated Aug. 28, 2020; Chinese Appln No. 201880013189.4.
(Continued)

*Primary Examiner* — Haissa Philogene
(74) *Attorney, Agent, or Firm* — Jefferson IP Law, LLP

(57) ABSTRACT

Various embodiments of the present invention pertain to an instrument comprising a plane lens antenna and a control method thereof. Particularly, embodiments pertain to an instrument comprising a plane lens antenna capable of adjusting the gain and/or coverage of a wireless communication radio wave, and to a control method of the instrument. The instrument according to the various embodiments may comprise: a first plane lens antenna in which a plurality of unit cells are disposed in a predetermined pattern; and a first support member for retaining the first plane lens antenna such that the antenna can have a predetermined distance with an external antenna device.

14 Claims, 16 Drawing Sheets

(51) Int. Cl.
*H01Q 1/24* (2006.01)
*H01Q 3/14* (2006.01)

(56) References Cited

U.S. PATENT DOCUMENTS

| | | | | |
|---|---|---|---|---|
| 6,822,622 | B2 * | 11/2004 | Crawford | H01Q 15/002 343/754 |
| 7,348,934 | B2 * | 3/2008 | Kuroda | H01Q 1/42 343/911 L |
| 8,068,053 | B1 * | 11/2011 | Stutzke | H01Q 19/062 342/75 |
| 8,811,511 | B2 * | 8/2014 | Sayeed | H01Q 19/06 375/267 |
| 9,999,038 | B2 * | 6/2018 | Barzegar | H04B 7/15542 |
| 10,297,900 | B2 * | 5/2019 | Lee | H01Q 1/38 |
| 10,498,029 | B1 * | 12/2019 | Tran | F21S 8/086 |
| 2003/0153361 | A1 | 8/2003 | Mori et al. | |
| 2007/0285327 | A1 | 12/2007 | Paschen et al. | |
| 2010/0001900 | A1 | 1/2010 | Imai et al. | |
| 2014/0047917 | A1 | 2/2014 | Vogt et al. | |
| 2015/0282196 | A1 | 10/2015 | Kim et al. | |
| 2015/0380829 | A1 | 12/2015 | Lee-Bouhours et al. | |
| 2015/0381212 | A1 | 12/2015 | Moon et al. | |
| 2016/0240923 | A1 | 8/2016 | Oh et al. | |
| 2016/0380353 | A1 | 12/2016 | Lysejko et al. | |
| 2020/0350680 | A1 * | 11/2020 | Yang | H01Q 3/245 |

FOREIGN PATENT DOCUMENTS

| | | | |
|---|---|---|---|
| FR | 3 002 697 | A1 | 8/2014 |
| JP | 2002-171119 | A | 6/2002 |
| JP | 2010-002350 | A | 1/2010 |
| KR | 10-2009-0042938 | A | 5/2009 |
| KR | 10-2009-0090744 | A | 8/2009 |
| KR | 10-2015-0112629 | A | 10/2015 |
| WO | 2016/134751 | A1 | 9/2016 |

OTHER PUBLICATIONS

Lima et al.; Circular Polarization Wide-Angle Beam Steering at Ka-Band by In-Plane Translation of a Plate Lens Antenna; IEEE Transactions on Antennas and Propagation; vol. 63, No. 12; XP011592419; Dec. 2015; Piscataway, NJ.

European Search Report dated Dec. 16, 2019; European Appln. No. 18756819.1-1205 /3573182 PCT/KR2018002057.

* cited by examiner

INSTRUMENT COMPRISING PLANE LENS ANTENNA AND CONTROL METHOD THEREOF

TECHNICAL FIELD

Various embodiments of the disclosure relate to an instrument including a plane lens antenna and to a control method thereof. More particularly, the disclosure relates to an instrument including a plane lens antenna capable of adjusting gain and/or coverage of a radio wave and to a control method thereof.

BACKGROUND ART

In order to satisfy the increasing demands of radio data traffic after the commercialization of a 4G communication system, efforts have been made to develop an advanced 5G communication system or a pre-5G communication system. The 5G communication system or the pre-5G communication system is also referred to as a beyond-4G network system or a post-LTE system. In order to accomplish a higher data transfer rate, the 5G communication system may provide a wireless communication service in a super-high frequency (mmWave) band (e.g., a 60 GHz band).

Also, in order to obviate a propagation loss of a radio wave and increase a delivery distance of a radio wave in the super-high frequency band, discussions for the 5G communication system are underway about various techniques such as a beamforming, a massive MIMO, a full dimensional MIMO (FD-MIMO), an array antenna, an analog beamforming, and a large scale antenna.

DISCLOSURE OF INVENTION

Technical Problem

In the 5G communication system, the coverage range of the radio wave is extremely limited because the super-high frequency band is used. For example, the radio wave of the super-high frequency band has characteristics of high directivity and low diffraction, thus suffering a great loss due to obstacles (e.g., buildings or geographic features).

In order to prevent such a loss, a lens antenna, which was used in the early stage of microwave communication, has recently attracted attention again. The lens antennas can be used, for example, to improve the gain and/or coverage of the radio waves by using principles similar to an optical lens.

Particularly, with the recent growth of technologies, a plane lens antenna in which a dielectric and a metal pattern are printed on a multilayer printed circuit board (MPCB) has appeared.

Various embodiments of the disclosure are to provide an instrument including a plane lens antenna for adjusting the gain and/or coverage of a radio wave and also provide a control method thereof.

Solution to Problem

According to various embodiments, an instrument may include a first plane lens antenna including a plurality of unit cells disposed in a predetermined pattern, and a first support member allowing the first plane lens antenna to maintain a predetermined distance from an external antenna device.

According to various embodiments, a set-top box device may include an antenna device including at least one antenna, and a plane lens antenna that is parallel to the antenna device and includes a plurality of unit cells arranged in a predetermined pattern.

According to various embodiments, a control method of an electronic device including a plane lens antenna may include receiving a first signal strength measurement value of a set-top box device from at least one base station; comparing the first signal strength measurement value with a pre-stored threshold value; controlling an operation of a driving unit when the first signal strength measurement value is smaller than the pre-stored threshold value; and receiving a second signal strength measurement value of the set-top box device from the at least one base station.

According to various embodiments, an electronic device may include a plane lens antenna including a plurality of unit cells disposed in a predetermined pattern; a communication interface configured to communicate with at least one base station; a driving unit including at least one motor; a memory storing instructions; and a processor electrically connected to the driving unit, the communication interface, and the memory, wherein the memory stores instructions that cause, when executed, the processor to receive a first signal strength measurement value of a set-top box device from the at least one base station by controlling the communication interface, to compare the first signal strength measurement value with a pre-stored threshold value, to control an operation of a driving unit when the first signal strength measurement value is smaller than the pre-stored threshold value, and to receive a second signal strength measurement value of the set-top box device from the at least one base station.

Advantageous Effects of Invention

The instrument including the plane lens antenna according to various embodiments of the disclosure can overcome the limitation of the super-high frequency (mmWave) band used in the 5G communication system, adjust the gain and/or coverage of the radio wave radiated from the antenna device, and realize a flexible construction of the wireless communication network.

MODE FOR THE INVENTION

Figure 1:
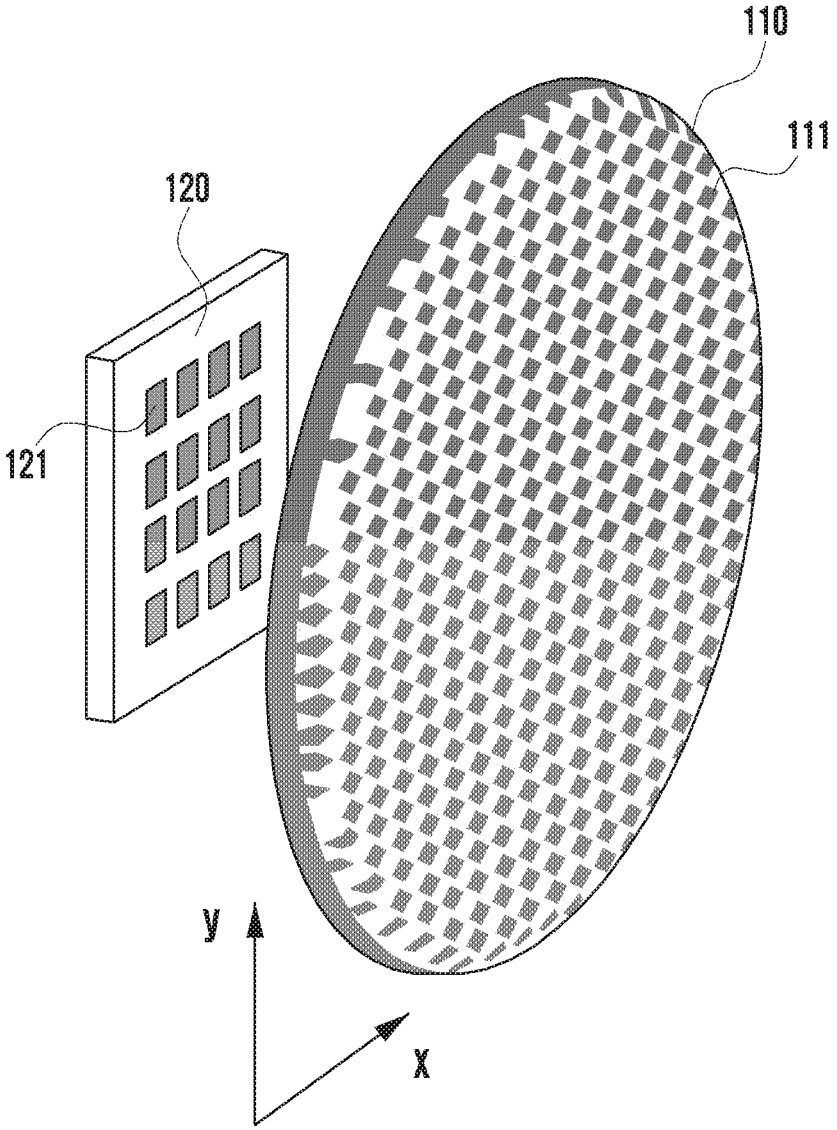
FIG. 1 is a diagram illustrating a plane lens antenna according to various embodiments.

Hereinafter, various embodiments of the disclosure are described in detail with reference to accompanying drawings. The embodiments and terms used herein are not intended to limit the technology disclosed in specific forms and should be understood to include various modifications, equivalents, and/or alternatives to corresponding embodiments. In the drawings, similar reference numbers are used to indicate similar constituent elements. As used herein, singular forms are intended to include the plural forms as well, unless the context clearly indicates otherwise. In the disclosure, the expression "A or B" or "at least one of A and/or B" is intended to include any possible combination of enumerated items. In the present disclosure, expressions such as "1st" or "first", "2nd" or "second", etc. may modify various components regardless of the order and/or the importance but do not limit corresponding components. When it is mentioned that a certain (first) component is "(functionally or communicatively) connected" to or "accessed" by another (second) component, it may be understood that the component is directly connected to or accessed by the other component or that still other (third) component is interposed between the two components.

In the disclosure, the expression "configured to ~" may be interchangeably used with other expressions "suitable for ~", "having the capacity to ~", "designed to ~", "adapted to ~", "made to ~", or "capable of ~". The expression "configured to (or set to) ~" may not necessarily mean "specifically designed to ~" in hardware. Instead, in some situations, the expression a device "configured to ~" may mean that the device is "capable of ~" with other devices or components. For example, a "processor configured to (or set to) perform A, B, and C" may mean a dedicated processor (e.g., an embedded processor) for performing a corresponding operation or a general-purpose processor (e.g., a central processing unit (CPU) or an application processor (AP)) which executes corresponding operations by executing one or more software programs which are stored in a memory device.

According to various embodiments of the disclosure, an electronic device may include at least one of a smart phone, a tablet PC, a mobile phone, a video phone, an e-book reader, a desktop PC, a laptop PC, a netbook computer, a workstation, a server, a personal digital assistant (PDA), a portable multimedia player (PMP), an MP3 player, a medical device, a camera, or a wearable device. The wearable device may include at least one of an appcessory type device (e.g. a watch, a ring, a bracelet, an anklet, a necklace, glasses, contact lens, and head-mounted-device (HMD), a textile or clothes-integrated device (e.g., electronic clothes), a body-attached device (e.g., skin pad and tattoo), or a bio-implantable circuit. In a certain embodiment, the electronic device may be home appliance including at least one of television (TV), a digital video disk (DVD) player, an audio player, an air conditioner, a cleaner, an oven, a microwave oven, a washing machine, an air cleaner, a set-top box device, a home automation control panel, a security control panel, a media box, a game console, an electronic dictionary, an electronic key, a camcorder, or an electronic frame.

According to another embodiment, the electronic device may include at least one of a medical device (such as portable medical measuring devices (including a glucometer, a heart rate monitor, a blood pressure monitor, or a body temperature thermometer), a magnetic resonance angiography (MRA) device, a magnetic resonance imaging (MRI) device, a computed tomography (CT) device, a camcorder, or a microwave scanner), a navigation device, a global navigation satellite system (GNSS), an event data recorder (EDR), a flight data recorder (FDR), an automotive infotainment device, marine electronic equipment (such as marine navigation system or gyro compass), aviation electronics (avionics), security equipment, an automotive head unit, an industrial or household robot, a drone, an automatic teller machine (ATM), a point of sales (POS) terminal, or an Internet-of-things (IoT) device (such as electric bulb, sensor, sprinkler system, fire alarm system, temperature controller, street lamp, toaster, fitness equipment, hot water tank, heater, or boiler). According to a certain embodiment, the electronic device may include at least one of furniture, a part of a building/structure, a part of a vehicle, an electronic board, an electronic signature receiving device, a projector, or a sensor (such as water, electricity, gas, or electric wave meters). According to various embodiments, the electronic device may be flexible or a combination of at least two of the aforementioned devices. According to a certain embodiment, the electronic device is not limited to the aforementioned devices. In the disclosure, the term "user" may denote a person who uses the electronic device or a device (e.g., artificial intelligent electronic device) which uses the electronic device.

FIG. 1 is a diagram illustrating a plane lens antenna according to various embodiments.

According to various embodiments, the plane lens antenna 110 includes a plurality of unit cells 111, and each unit cell 111 may include a dielectric material and a metal pattern. In each unit cell 111, the content of the dielectric material and/or the metal pattern may determine the inherent dielectric constant of each unit cell 110. Further, this dielectric constant may determine the refractive index of the radio wave. That is, based on how the unit cells 111 each having the inherent dielectric constant are arranged in the plane lens antenna 110, the characteristics of the plane lens antenna 110 itself may be determined.

According to various embodiments, the plane lens antenna 110 may include at least one of a gain correction characteristic, a one-dimensional phase correction characteristic, and a two-dimensional phase correction characteristic. Specifically, the plane lens antenna 110 is capable of correcting the gain or correcting the phase by refracting the radio wave radiated from an antenna device 120 including a plurality of antennas 121. For example, in the plane lens antenna 110, the unit cells 111 having the same dielectric constant are disposed in the x-axis direction, and the unit cells 111 having different dielectric constants are disposed in the y-axis direction. When the radio wave radiated from the antenna device 120 passes through the plane lens antenna 110 in the x-axis direction, the plane lens antenna 110 may refract the incident radio wave and thereby amplify the x-axis coverage of the radio wave output. In addition, when the radio wave radiated from the antenna device 120 passes through the plane lens antenna 110 in the y-axis direction, the plane lens antenna 110 may focus the radio wave and thereby increase the gain of the radio wave output.

Figure 2:
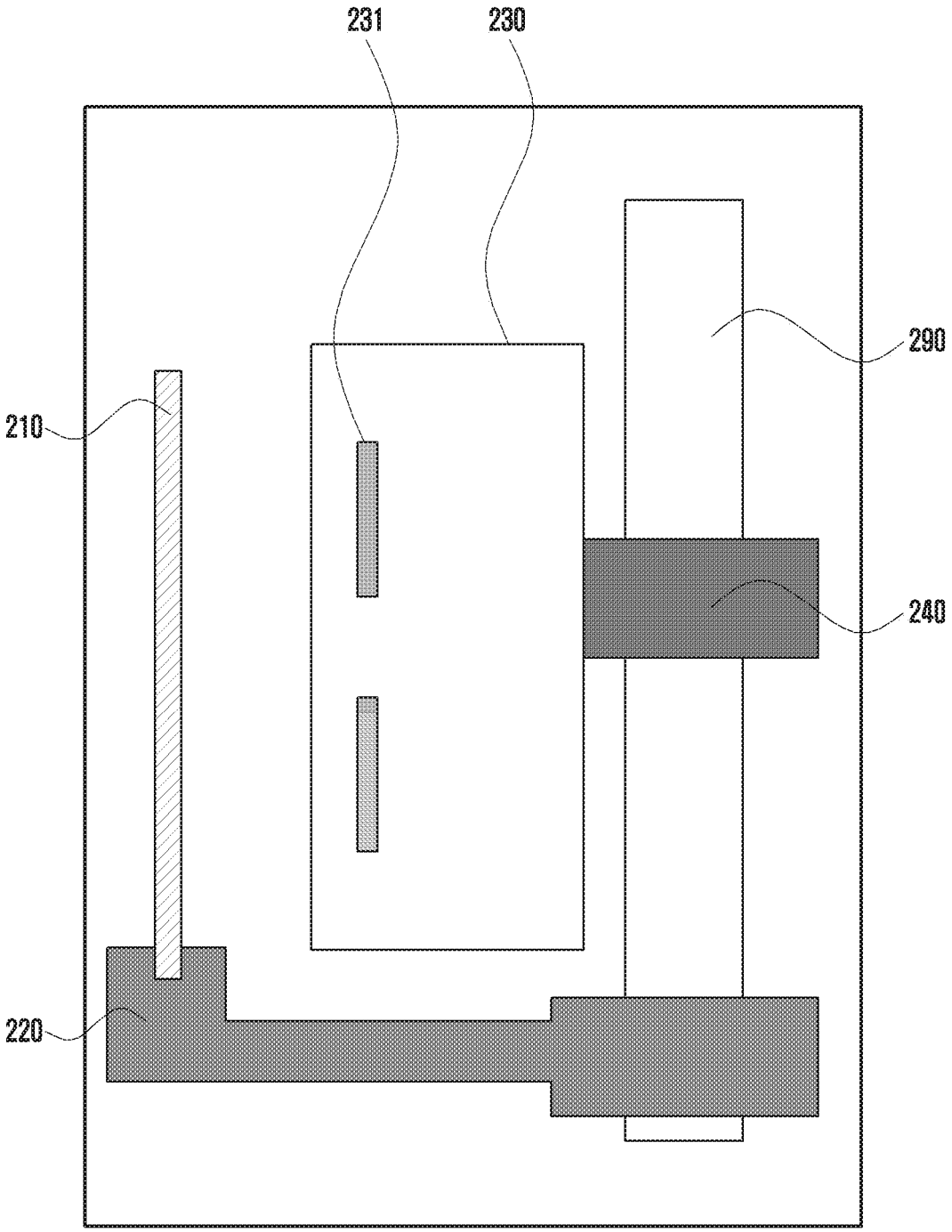
FIG. 2 is a diagram illustrating an instrument including a plane lens antenna according to various embodiments.

FIG. 2 is a diagram illustrating an instrument including a plane lens antenna according to various embodiments.

According to various embodiments, the instrument including the plane lens antenna 210 may include the plane lens antenna 210 having a plurality of unit cells arranged in a predetermined pattern, and a support member 220 for allowing the plane lens antenna 210 to maintain a predetermined distance from an external antenna device 231.

In the 5G communication system, the transmission/reception coverage of the radio wave is extremely limited because the super-high frequency (mmWave) band having the high directivity is used. In consideration of this characteristic, a set-top box device or a base station available for the 5G communication system may include at least one antenna device, for example. Particularly, such an antenna device may adopt at least one of the following techniques used in the 5G communication system: a beamforming, a massive MIMO, a full dimensional MIMO (FD-MIMO), an array antenna, an analog beam-forming, and a large scale antenna. Although the array antenna is described herein as an embodiment of the antenna device, the antenna device according to various embodiments of the disclosure is not limited to the array antenna and may be applied to various antenna devices.

Various techniques for obviating a propagation loss of the radio wave and increasing a delivery distance of the radio wave are being discussed in the 5G communication system, but there is a limitation in freely installing a set-top box device or a base station to which these techniques are applied. In particular, even though the above techniques are applied to the existing urban models in which the installation location of the set-top box device or the base station is predetermined, it is unlikely to flexibly cover the entire city model.

The instrument that includes the plane lens antenna according to various embodiments of the disclosure is helpful in flexibly constructing a wireless communication network by adjusting the gain and/or coverage of the radio wave radiated from the antenna device in consideration of the above-discussed limitation.

The plane lens antenna 210 may include at least one of a gain correction characteristic, a one-dimensional phase correction characteristic, and a two-dimensional phase correction characteristic, for example. Various plane lens antennas can be flexibly used in consideration of the environment of the urban model while correcting the characteristics of the radio wave to provide an optimal wireless communication network for the urban model. For example, the plane lens antenna 210 having a gain correction characteristic may be used to support long-range wireless communication, and also the plane lens antenna 210 having a vertical phase correction characteristic may be used to support wireless communication for high-rise buildings.

According to various embodiments, the support member 220 may allow the plane lens antenna 210 to maintain a given distance from the antenna device 231 included in a certain external device 230.

According to various embodiments, it is preferable that the plane lens antenna 210 is disposed in parallel with the antenna device 231 included in the external device 230 while maintaining a given distance. The plane lens antenna 210 disposed in parallel may be configured to have a larger area than the antenna device 231 in consideration of the given distance so as to prevent a loss of the radio wave radiated from the antenna device 231.

In some embodiments, the plane lens antenna 210 may be disposed obliquely at a certain angle from the antenna device 231. For example, when the antenna device 231 is an array antenna, the antenna device 231 may adjust the directivity of the radio wave by using a beam steering technique or the like. If this antenna device 231 steers the radio wave at an angle of about 45 degrees from the direction perpendicular to the antenna device 231, it is desirable that the plane lens antenna 210 is disposed obliquely at an angle to correspond to the steering direction of the radio wave.

Figure 3:
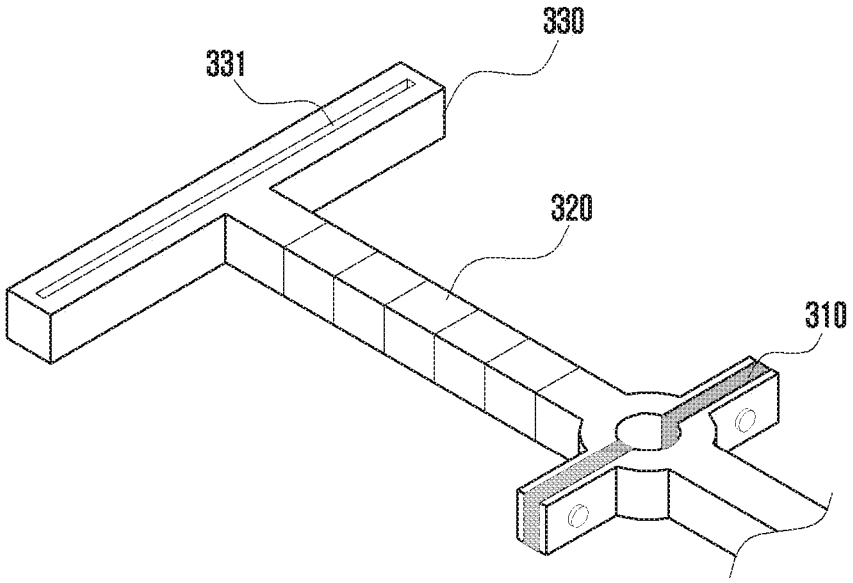
FIG. 3 is a diagram illustrating a support member according to various embodiments.

FIG. 3 is a diagram illustrating a support member according to various embodiments.

According to various embodiments, the instrument including the plane lens antenna 210 may be configured such that the support member 220 adjusts a distance between the antenna device 231 and the plane lens antenna 210.

Referring to FIG. 3, the support member may include a fixing part 310, a length adjusting part 320, and a lens mounting part 330.

The fixing part 310 may have various shapes depending on, for example, the installation environment of the set-top box device or the base station. FIG. 3 shows the fixing part having a shape suitable for being fixed to a pole on the assumption that the external device is installed on the pole. This shape is exemplary only, and any other shape suitable for the installation environment is possible. Also, in FIG. 3, fastening members such as a bolt and a nut may be used for example to fix the support member to the pole. However, any other fixing mechanism is also possible.

The length adjusting part 320 may have various shapes to adjust the distance between the plane lens antenna 210 and the antenna device 231. For example, the length adjusting part 320 may be configured in a foldable form. Also, the length adjusting part 320 may be manually adjusted in length or automatically adjusted in length in response to a signal requesting a distance adjustment.

The lens mounting part 330 may have various shapes to mount the plane lens antenna 210 thereon. For example, the lens mounting part 330 may be formed with a groove 331 into which the plane lens antenna 210 can be inserted for mounting.

According to various embodiments, the instrument including the plane lens antenna may be configured to include at least two support members 220. For example, if the support member 220 as shown in FIG. 3 is configured to support the plane lens antenna 210 in both upper and lower directions, the instrument may be made more robust from an external impact or the like.

Figure 4:
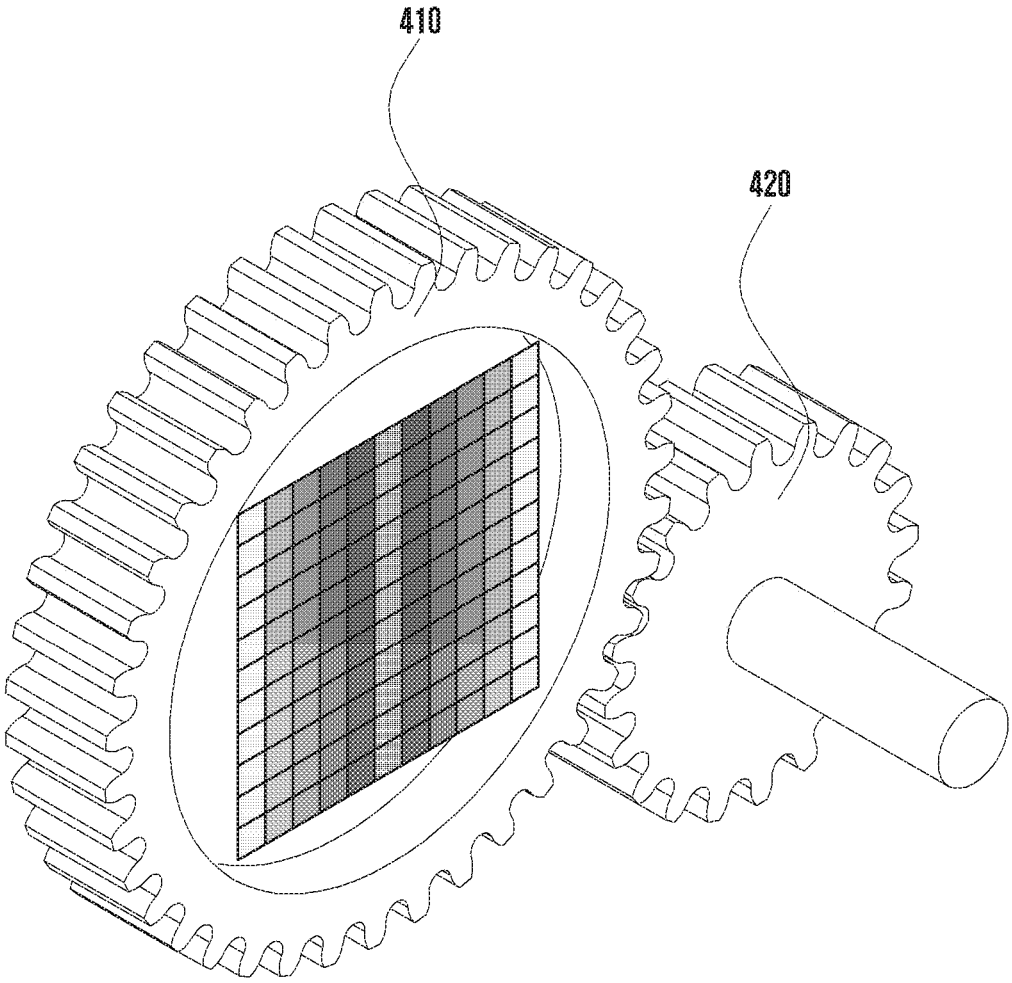
FIG. 4 is a diagram illustrating a first rotary member according to various embodiments.

FIG. 4 is a diagram illustrating a first rotary member according to various embodiments.

According to various embodiments, the instrument including the plane lens antenna may further include a first rotary member 420 so that the plane lens antenna 210 can be rotated about a central axis perpendicular to the plane lens antenna 210. For example, the plane lens antenna 210 may have a gearwheel 410 on an edge portion thereof, and the first rotary member 420 may have another gearwheel which is engaged with the gearwheel 410 of the plane lens antenna. Thus, the first rotary member 420 can rotate the plane lens antenna 210 with respect to the central axis perpendicular to the plane lens antenna 210.

According to various embodiments, the plane lens antenna 210 may be manually rotated or automatically rotated based on a signal for requesting a rotation.

Figure 5A:
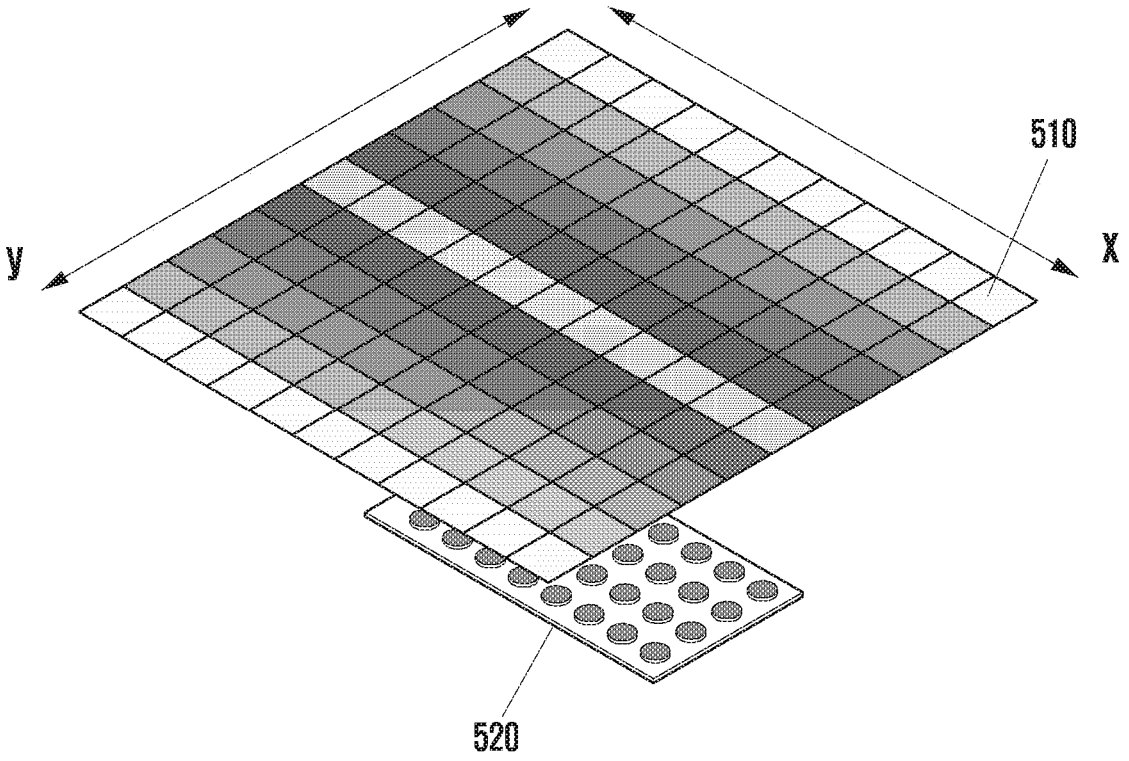
FIGS. 5A to 5C are diagrams illustrating effects caused by a rotation of a plane lens antenna 210 according to an embodiment.
Figure 5B:
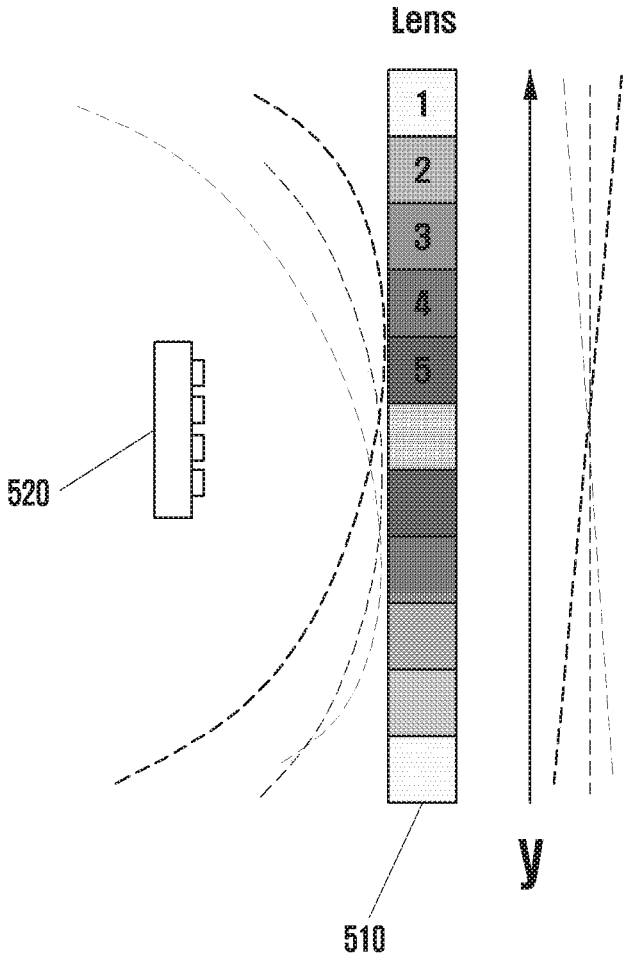
Figure 5C:
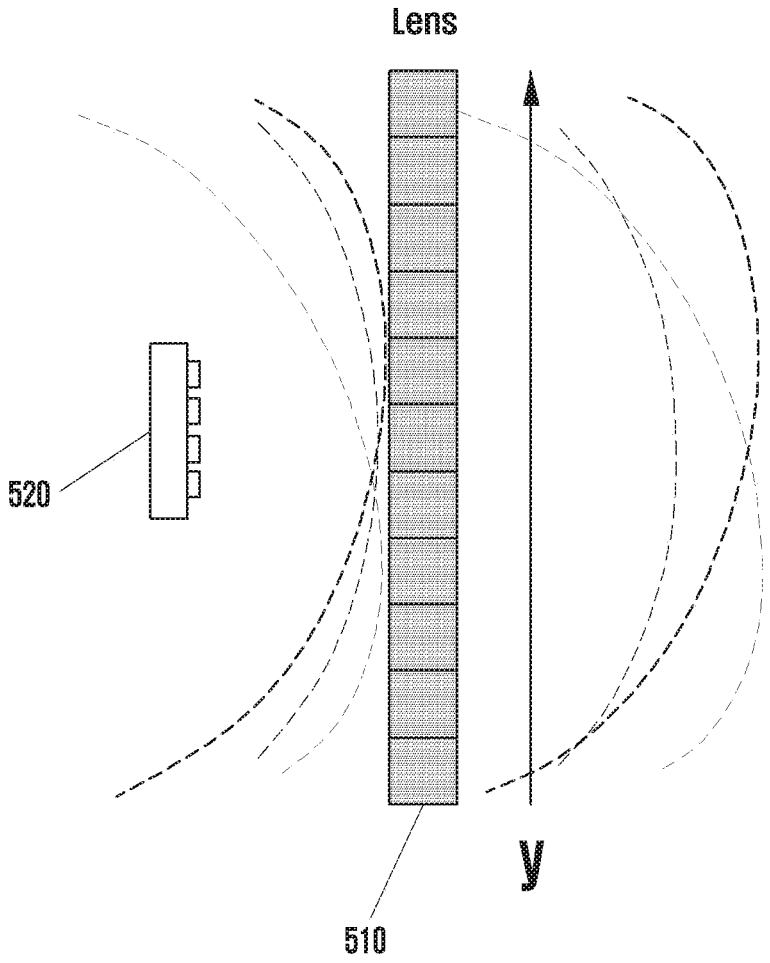

FIGS. 5A to 5C are diagrams illustrating effects caused by a rotation of a plane lens antenna 210 according to an embodiment.

Referring to FIG. 5A, the plane lens antenna 510 may be configured such that the unit cells having the same dielectric constant are arranged in a linear pattern. For example, in the plane lens antenna, the unit cells having the same dielectric constant may be arranged in the x-axis direction, and the unit cells having different dielectric constants may be arranged in the y-axis direction. In this example, when the radio waves radiated from the antenna device 520 pass through the x-axis direction, the radio waves incident on the plane lens antenna 510 and the radio waves outputted from the plane lens antenna 510 have the same phase, thus causing the coverage to be expanded. In addition, when the radio waves radiated from the antenna device 520 pass through the y-axis direction, the radio waves incident on the plane lens antenna 510 are refracted to have the same phase, thus causing the gain of the radio waves to be increased.

FIG. 5B is a view showing the phase of radio waves outputted when the plane lens antenna 510 shown in FIG. 5A is viewed from one side. FIG. 5C is a view showing the phase of radio waves outputted when the plane lens antenna 510 shown in FIG. 5B is rotated at 90 degrees.

Referring to FIG. 5B, the radio waves radiated from the antenna device 520 can be corrected to have the same phase while passing through the unit cells having different dielectric constants in the plane lens antenna 510. For example, the radio waves incident on the plane lens antenna 510 can be refracted in a direction perpendicular to the plane lens antenna 510, so that the gain of the radio waves can be increased in the direction perpendicular to the plane lens antenna 510. Although not shown, it is possible to steer the radio waves incident on the plane lens antenna 510 in a specific direction by using the unit cells having different dielectric constants.

Referring to FIG. 5C, when the radio waves radiated from the antenna device 520 pass through the unit cells having the same dielectric constant, the phase of the radio waves can be maintained. That is, this may be suitable for use in environments that require a wide coverage.

That is, a radiation pattern of the radio waves being outputted can be varied depending on how the plane lens antenna 510 is disposed. It is therefore possible to rotate the plane lens antenna 510 in a form most suitable for the use environment.

Figure 6:
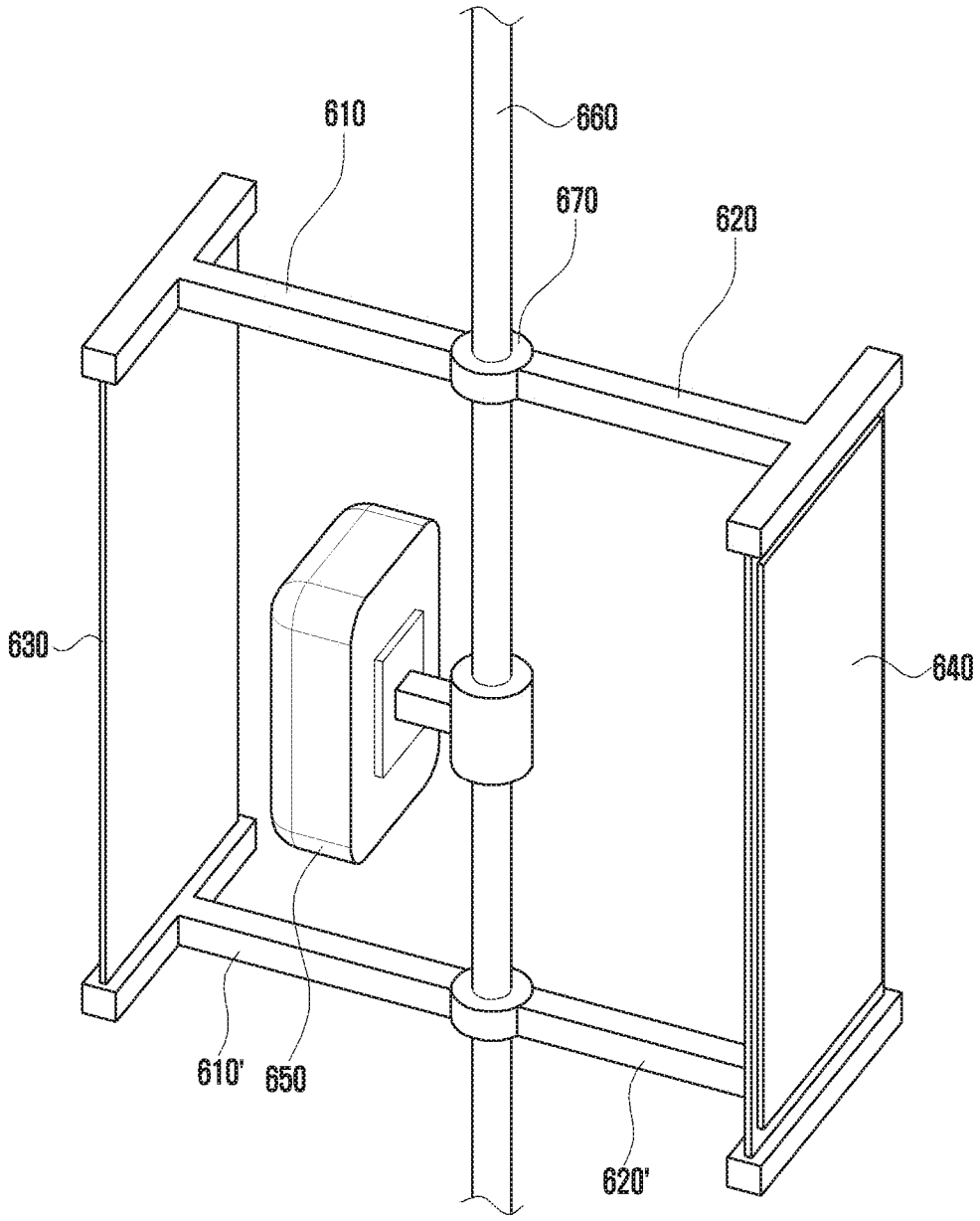
FIG. 6 is a diagram illustrating an instrument including a plane lens antenna according to various embodiments.

FIG. 6 is a diagram illustrating an instrument including a plane lens antenna according to various embodiments.

According to various embodiments, the instrument including the plane lens antenna may further include a second plane lens antenna 640 having a plurality of unit cells arranged in a certain pattern different from that of a first plane lens antenna 630, and a second support member 620 for allowing the second planer lens antenna 640 to maintain a certain distance from an antenna device included in an external device 650. In addition, the instrument may further include a second rotary member 670 for allowing the first plane lens antenna 630 or the second plane lens antenna 640 to be relatively close to the antenna device included in the external device 650.

According to various embodiments, the first support member 610 and the second support member 620 may be disposed in different directions with respect to a pole 660. The first support member 610 and the second support member 620 may support the first plane lens antenna 630 and the second plane lens antenna 640, respectively. The first plane lens antenna 630 and the second plane lens antenna 640 may have different characteristics.

According to various embodiments, the first support member 610 and the second support member 620 may be fastened to the pole 660 through the second rotary member 670. The second rotary member 670 may rotate the first support member 610 and the second support member 620 about the pole 660.

According to various embodiments, because both the first support member 610 and the second support member 620 are combined with and rotated about the pole 660, the first plane lens antenna 630 or the second plane lens antenna 640 may be alternately disposed in the vicinity of the antenna device included in the external device 650. Therefore, for example, if the first plane lens antenna 630 has a gain correction characteristic, and if the second plane lens antenna 640 has a phase correction characteristic, it is possible to flexibly construct a wireless communication network by selectively using one of the first and second plane lens antennas.

The functions described above with reference to FIGS. 3 to 7 are not independent from each other, and may be applied together. For example, a certain instrument may include all of the support member for adjusting a distance and the first and second rotary members, and another instrument may include only some of them.

According to various embodiments, the instrument including the plane lens antenna may be configured to include at least two support members. For example, as shown in FIG. 6, the first plane lens antenna 630 may be supported using a first pair of support members 610 and 610' in both the upper and lower directions, and the second plane lens antenna 640 may be supported using a second pair of support members 620 and 620' in both the upper and lower directions.

Figure 7:
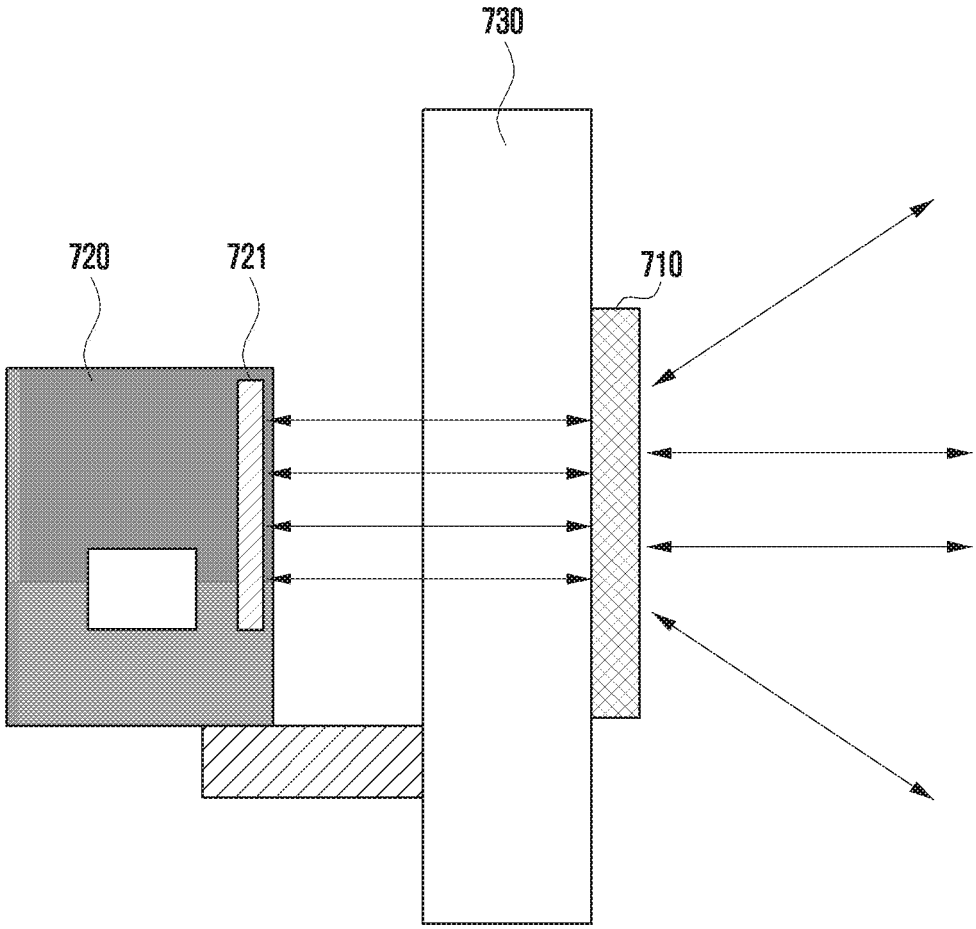
FIG. 7 is a diagram illustrating a method of installing a plane lens antenna in an environment including a glass wall according to various embodiments.

FIG. 7 is a diagram illustrating a method of installing a plane lens antenna in an environment including a glass wall according to various embodiments.

The radio wave of the super-high frequency band being used in the 5G communication system has characteristics of high directivity and low diffraction, so that it may suffer a great loss due to obstacles (e.g., buildings or geographic features). Meanwhile, a glass wall 730 has very high transmittance in comparison with other obstacles even though a loss of radio wave occurs. Nevertheless, a large difference may arise between the passing rate of the radio wave incident perpendicularly to the glass wall 730 and the passing rate of the radio wave incident obliquely.

According to various embodiments, applying a plane lens antenna 710 to the glass wall 730 may reduce the loss rate of radio waves. For example, the plane lens antenna 710 may be attached directly or indirectly to an outside of the glass wall 730. The plane lens antenna 710 attached to the glass wall 730 may receive the radio waves radiated from any external point and pass them through the unit cells having different dielectric constants. The respective unit cells may correct the incident radio waves to have the same phase, and the corrected radio waves may pass through the glass wall 730 with a high passing rate. Particularly, when the external device 720 including the antenna device 721 is disposed around an inside of the glass wall 730, the external device 720 may easily communicate with an object located around the outside of the glass wall through the plane lens antenna 710. In addition, when the radio waves are radiated from the antenna device 721 included in the external device 720, the radiated radio waves may be delivered to the plane lens antenna 710 through the glass wall 730, and then the plane lens antenna 710 may correct and radiate the radio waves to have a wide coverage.

Although not shown, the plane lens antenna 710 may be attached to each of the outside and inside of the glass wall 730, and the external device 720 including the antenna device 721 may be located around and spaced from each of the outside and inside of the glass wall 730. In this case, the antenna device disposed around the inside of the glass wall 730 may receive the radio waves radiated from any external point and then radiate the received radio waves toward the plane lens antenna disposed around the inside of the glass wall 730. And then, the radio waves may sequentially pass through the plane lens antenna disposed around the inside of the glass wall 730 and the plane lens antenna disposed around the outside of the glass wall, and eventually arrive at the antenna device disposed around the outside of the glass wall 730. This configuration is helpful in significantly reducing the loss rate of the radio waves in comparison with using a single plane lens antenna.

FIGS. 8 to 11 are diagram illustrating a set-top box device according to various embodiments.

According to various embodiments, the set-top box device 810 may include an antenna device 830 including at least one antenna, and a plane lens antenna 820 being parallel to the antenna device 830 and including a plurality of unit cells disposed in a certain pattern.

The set-top box device 810 is available for the 5G communication system and may include at least one antenna device 830. Particularly, such an antenna device may adopt at least one of the following techniques used in the 5G communication system: a beamforming, a massive MIMO, a full dimensional MIMO (FD-MIMO), an array antenna, an analog beam-forming, and a large scale antenna.

Figure 8:
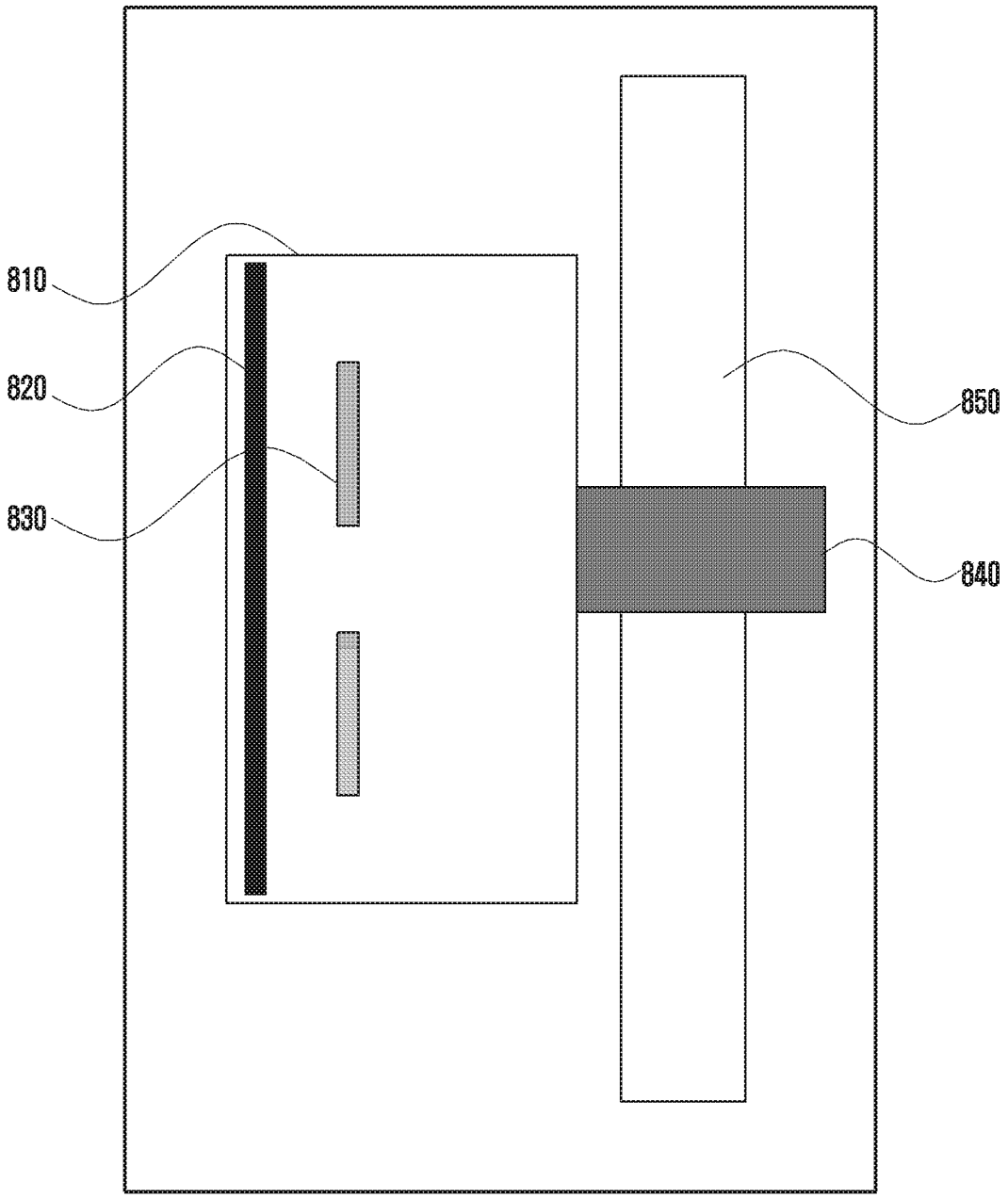
FIGS. 8 to 11 are diagram illustrating a set-top box device according to various embodiments.

Referring to FIG. 8, the set-top box device 810 may include a housing that accommodates the antenna device 830 and the plane lens antenna 820 and also protects both the antenna device 830 and the plane lens antenna 820 from an external impact. FIG. 8 shows a state in which the set-top box device 810 is fixed to a pole 850 through a set-top box device fixing member 840. This is, however, exemplary only, and the set-top box device 810 may be installed in a variety of environments.

Figure 9:
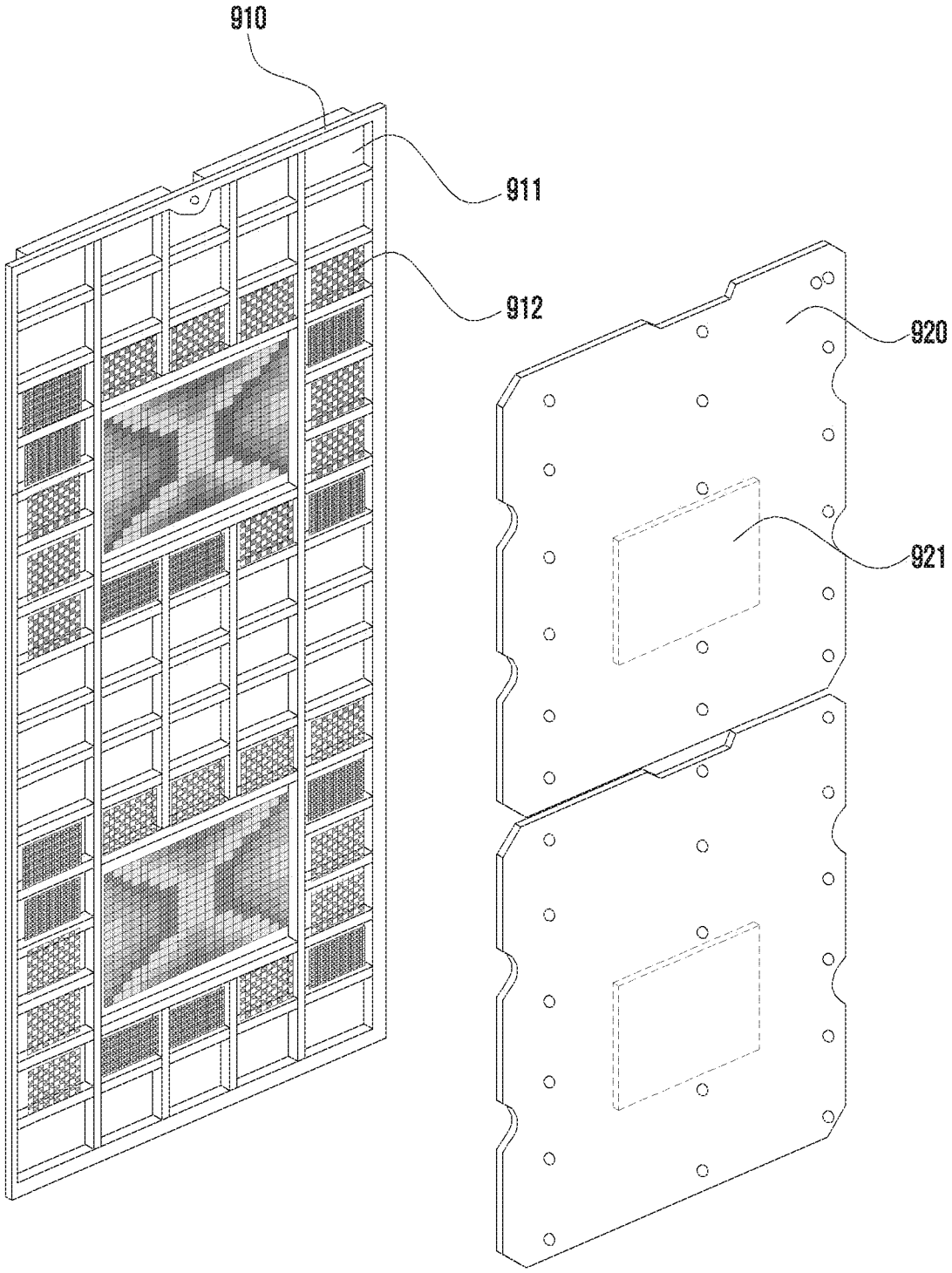

Referring to FIG. 9, the housing of the set-top box device 810 may include a wall 910 having a plurality of ribs 911 formed to face an antenna device 921. The ribs 911 may provide, for example, a function of securing a space or reinforcing rigidity.

According to various embodiments, a plane lens antenna 912 may be disposed to correspond to at least some of the plurality of ribs 911. For example, the plane lens antenna 912 may be formed at a portion of the wall to cover the antenna device 921. Disposing the plane lens antenna 912 for at least some of the ribs 911 may allow adjusting the gain and/or coverage of the radio waves radiated to the antenna device 921.

Figure 10:
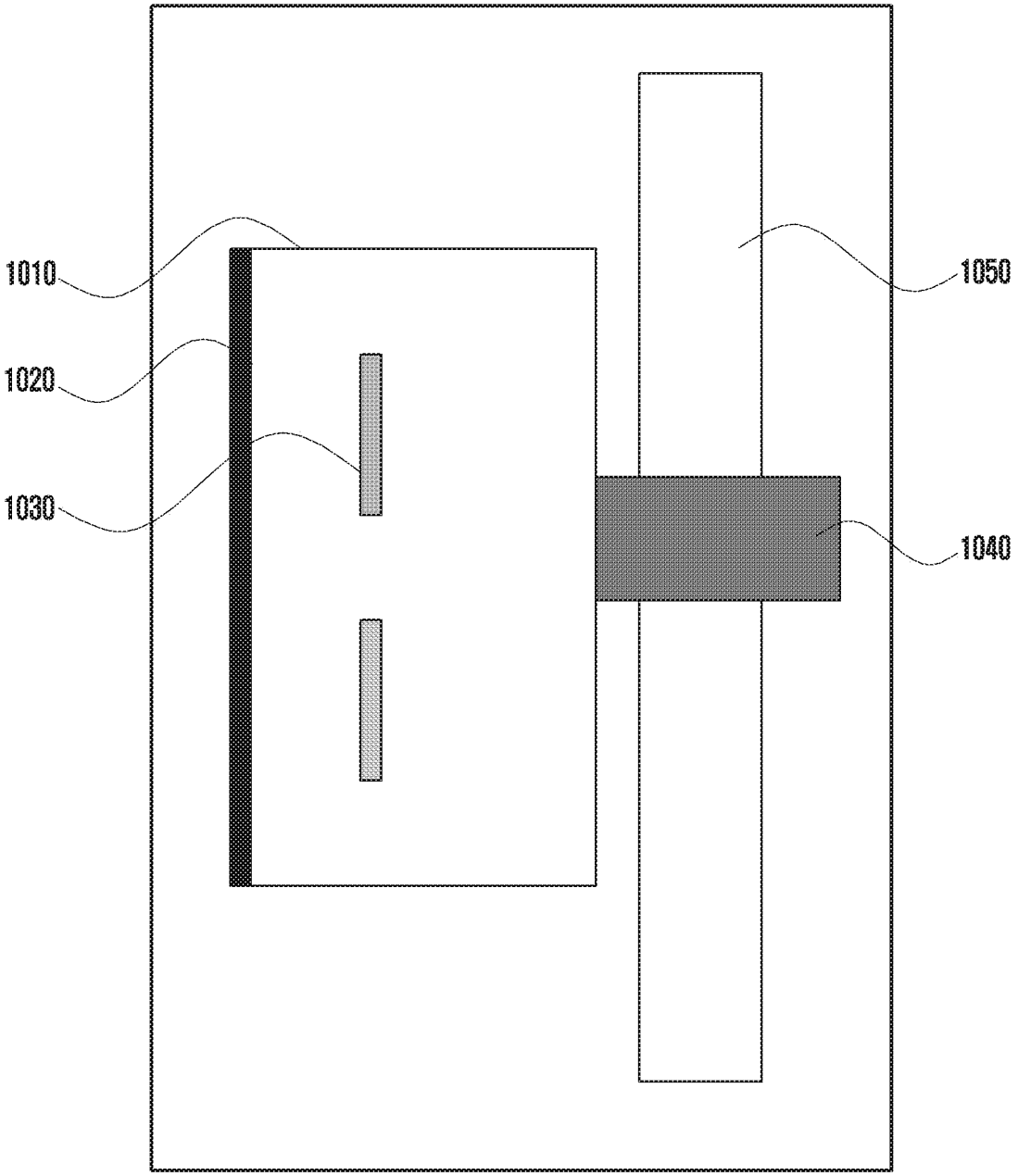

Referring to FIG. 10, there is shown an embodiment in which at least one wall of the housing is formed of a plane lens antenna 1020. In this case, the radio waves radiated from an antenna device 1030 pass through the wall formed of the plane lens antenna 1020, and thereby the gain and/or coverage thereof may be adjusted. FIG. 10 shows a state in which a set-top box device 1010 is fixed to a pole 1050 through a set-top box device fixing member 1040. This is, however, exemplary only, and the set-top box device 1010 may be installed in a variety of environments.

Figure 11:
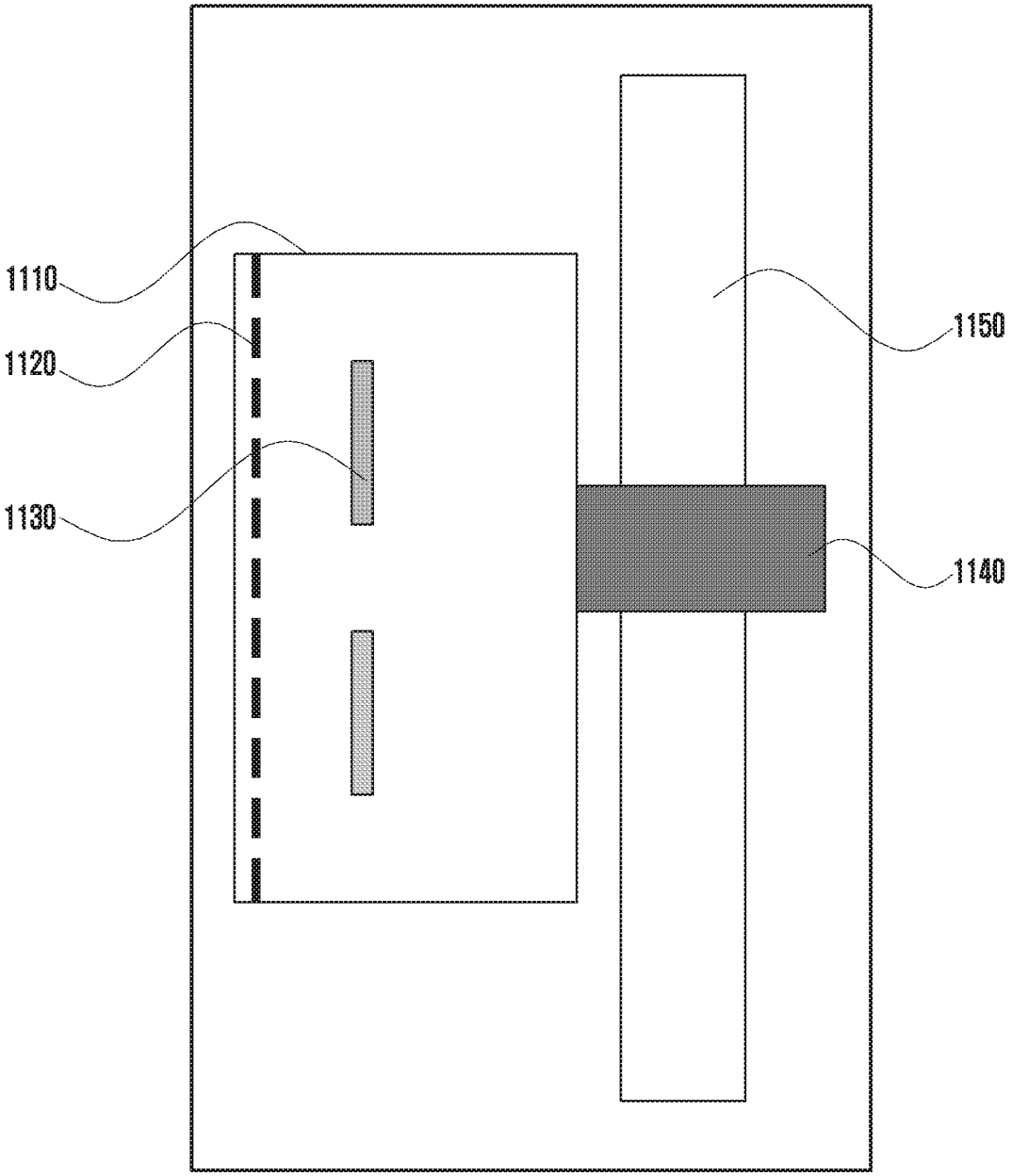

Referring to FIG. 11, there is shown an embodiment in which a plane lens antenna 1120 is printed on at least one wall of the housing. In this case, the radio waves radiated from an antenna device 1130 pass through the wall on which the plane lens antenna 1120 is printed, and thereby the gain and/or coverage thereof may be adjusted. FIG. 11 shows a state in which a set-top box device 1110 is fixed to a pole 1150 through a set-top box device fixing member 1140. This is, however, exemplary only, and the set-top box device 1110 may be installed in a variety of environments.

Figure 12:
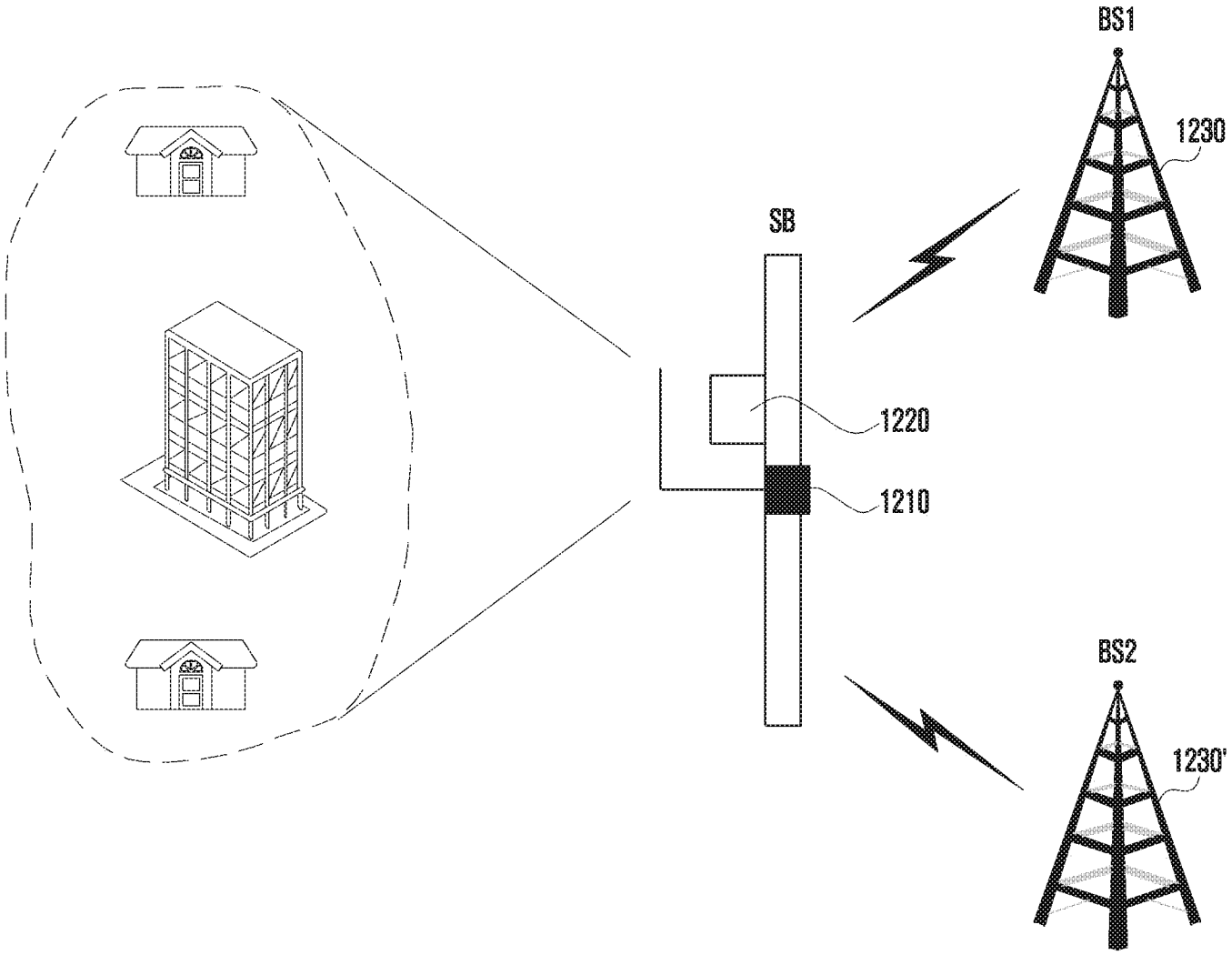
FIG. 12 is a diagram illustrating an installation environment of an electronic device according to various embodiments.

FIG. 12 is a diagram illustrating an installation environment of an electronic device according to various embodiments.

Referring to FIG. 12, a set-top box device 1220 may communicate with a first base station 1230 and/or a second base station 1230' in a wired or wireless manner. The set-top box device 1220 may be connected to an external network through the first base station 1230 and/or the second base station 1230'. The set-top box device 1220 may radiate data transmitted/received to/from the first base station 1230 and/or the second base station 1230' to the outside by using an internal antenna device.

According to various embodiments, an electronic device 1210 may include a first plane lens antenna having a plurality of unit cells arranged in a certain pattern, and a first support member for allowing the first plane lens antenna to maintain a certain distance from an external antenna device. The electronic device 1210 may be disposed adjacent to the set-top box device 1220 to adjust the gain and/or coverage of radiated radio waves.

According to various embodiments, the electronic device 1210 may communicate with the first base station 1230 and/or the second base station 1230' through a separate communication interface from the set top box device 1220. In some embodiments, the electronic device 1210 may perform short-range communication with the set-top box device 1220 and thus communicate with the first base station 1230 and/or the second base station 1230' via the set-top box device 1220.

The electronic device 1210 can flexibly adjust the plane lens antenna depending on the installation environment of the set-top box device 1220, thereby constructing an efficient wireless communication network.

Figure 13:
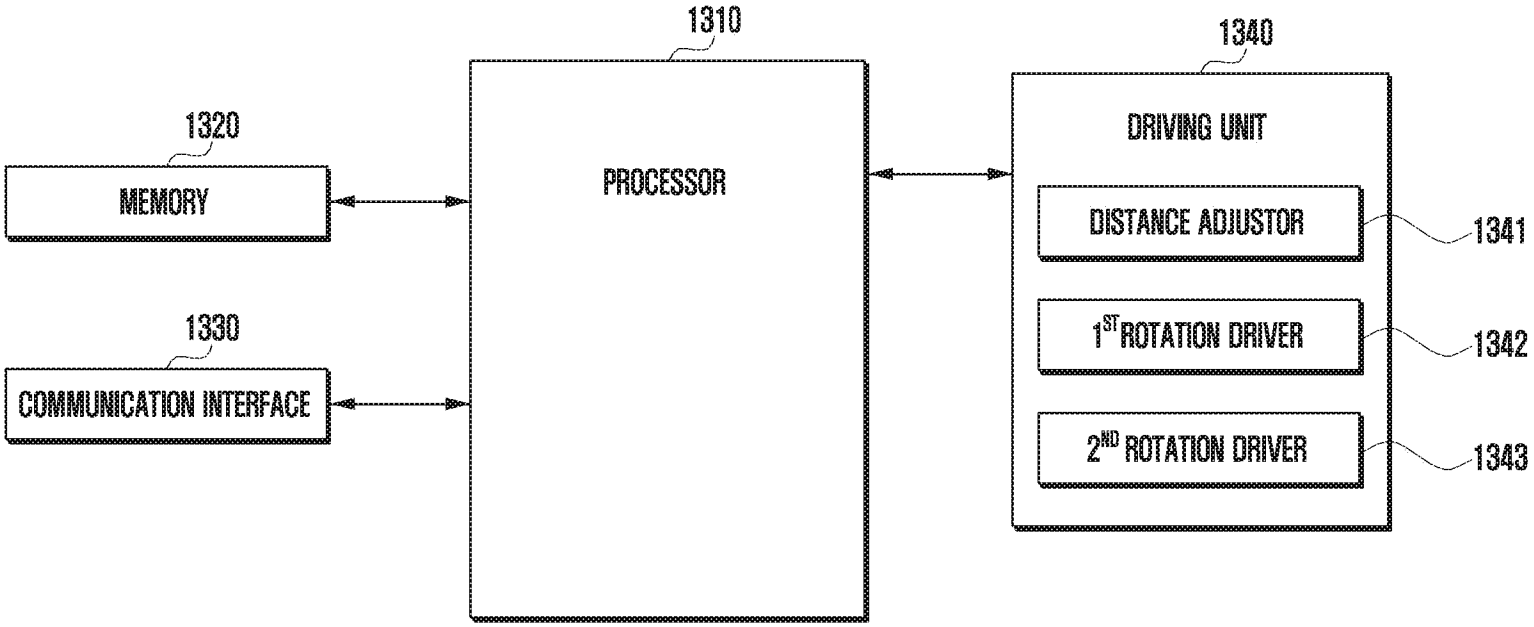
FIG. 13 is a block diagram illustrating an electronic device according to various embodiments.

FIG. 13 is a block diagram illustrating an electronic device according to various embodiments.

The electronic device may include all or part of an electronic device 1301 shown in FIG. 13. The electronic device 1301 may include one or more processors 1310 (e.g., an AP), a memory 1320, a communication interface 1330, and a driving unit 1340.

The processor 1310 may execute the operation system or application program to control a plurality of hardware or software components connected to the processor 1310 and perform various data processing and operations. The processor 1310 may be implemented in the form of system on chip (SoC) by way of example. The processor 1310 may load commands or data received from at least one of other components (e.g., a nonvolatile memory) onto a volatile memory and store processed result data in the nonvolatile memory.

The memory 1320 may include, for example, an internal memory and an external memory. The internal memory may include, for example, at least one of a volatile memory (e.g., DRAM, SRAM, or SDRAM) or a nonvolatile memory (e.g., one time programmable ROM (OTPROM)), PROM, EPROM, EEPROM, mask ROM, flash ROM, a flash memory, a hard drive, or a solid state drive (SSD)). The external memory may include, for example, a flash drive such as compact flash (CF), secure digital (SD), Micro-SD, Mini-SD, extreme digital (xD), multimedia card (MMC), or memory stick. The external electronic device may be functionally or physically connected with the electronic device via various interfaces.

The communication interface 1330 may include, for example, at least one of a cellular module, a Wi-Fi module, a Bluetooth module, a GNSS module, an NFC module, and an RF module. The RF module may transmit and receive a communication signal (e.g., RF signal). The RF module may include, for example, a transceiver, a power amp module (PAM), a frequency filter, a low noise amplifier (LNA), or an antenna.

The driving unit 1340 may include at least one of a distance adjuster 1341, a first rotation driver 1342, and a second rotation driver 1343. Each component may include at least one motor. For example, the motor may convert an electrical signal into a mechanical vibration and transmit a distance adjustable or rotational driving force. The distance adjuster 1341 may adjust a distance between the set-top box device and the plane lens antenna, for example, by driving at least one motor. The first rotation driver 1342 may rotate the plane lens antenna about a central axis perpendicular to the plane lens antenna by driving at least one motor. The second rotation driver 1343 may perform rotation on the pole, as a central axis, to which the electronic device is installed.

Figure 14:
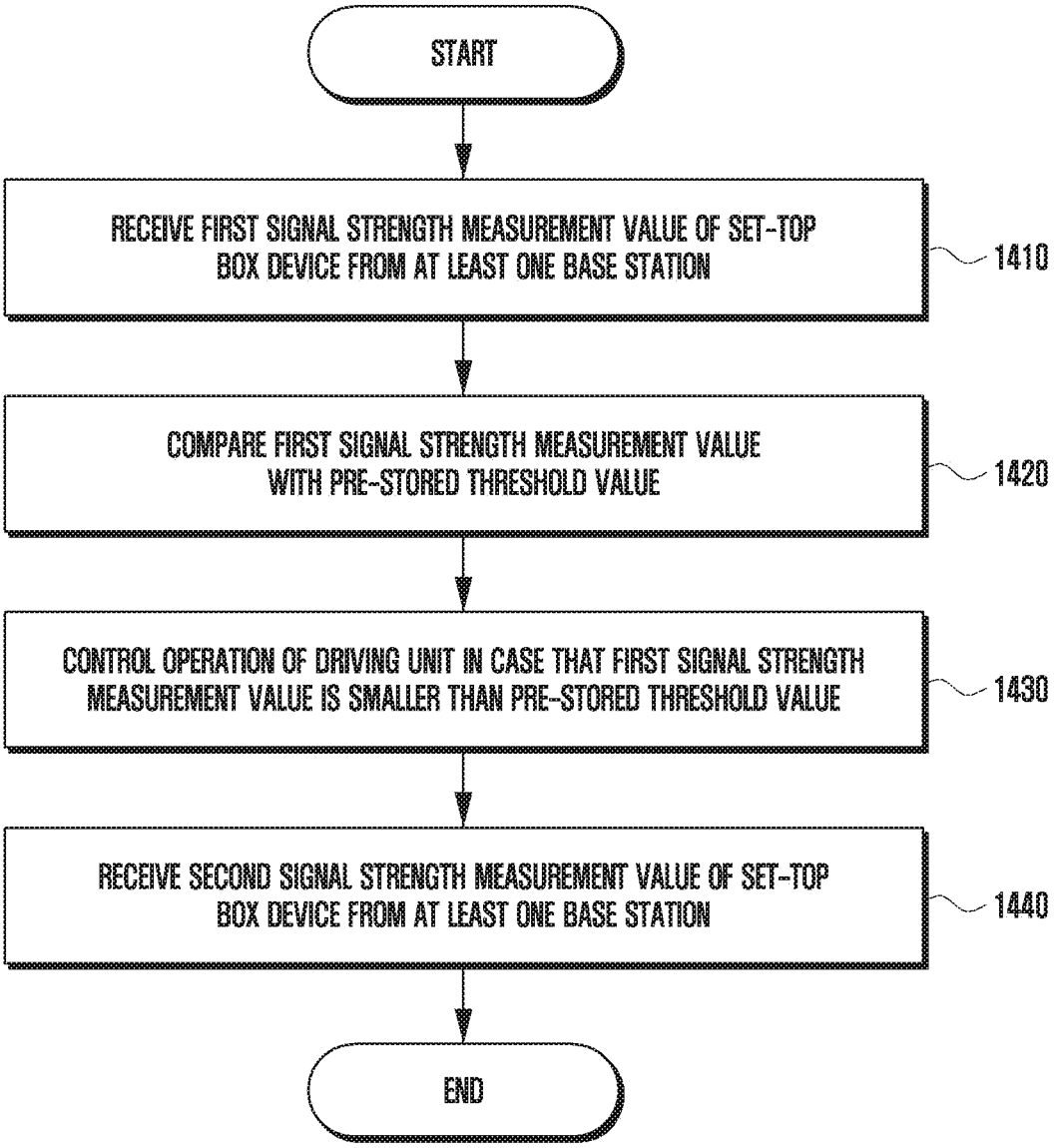
FIG. 14 is a flow diagram illustrating a control method of an electronic device according to various embodiments.

FIG. 14 is a flow diagram illustrating a control method of an electronic device according to various embodiments.

Referring to FIG. 14, at operation 1410, the at least one processor 1310 may receive a first signal strength measurement value for a set-top box device from at least one base station.

According to various embodiments, the base station may directly or indirectly measure the signal strength of the set-top box device. For example, the base station may directly measure the signal strength by receiving radio waves radiated from the set-top box device. In another example, an external device communicating with the set-top box device may measure the signal strength of the set-top box device, and the base station may determine the first signal strength of the set-top box device, based on the signal strength measured by the external device.

According to various embodiments, the base station may be configured to measure the signal strength periodically or in response to a signal requesting the measurement of the signal strength. In some embodiments, the base station may measure the signal strength when factors of the environment in which the set-top box device is installed are changed. For example, the base station may be configured to measure the signal strength when there is a new external device that requires communication with the set-top box device.

At operation 1420, the at least one processor 1310 may compare the first signal strength measurement value with a pre-stored threshold value.

According to various embodiments, the threshold value may be a minimum signal strength value required for smooth communication. The threshold value may be varied according to the usage environment and be set in advance. The memory may store the threshold value in advance.

At operation 1430, the at least one processor 1310 may control the operation of the driving unit when the first signal strength measurement value is smaller than the pre-stored threshold value.

According to various embodiments, the driving unit 1340 may include at least one of the distance adjuster 1341, the first rotation driver 1342, and the second rotation driver 1343. The distance adjuster 1341 may adjust a distance between the set-top box device and the plane lens antenna, for example, by driving at least one motor. The first rotation driver 1342 may rotate the plane lens antenna about a central axis perpendicular to the plane lens antenna by driving at least one motor. The second rotation driver 1343 may perform rotation on the pole, as a central axis, to which the electronic device is installed.

At operation 1440, the at least one processor 1310 may receive a second signal strength measurement value of an external device from at least one base station.

According to various embodiments, the base station may be configured to measure the signal strength periodically or in response to a signal requesting the measurement of the signal strength. The second signal strength measurement value may be compared with the pre-stored threshold value. When it is determined that the second signal strength measurement value is smaller than the pre-stored threshold value, the processor may control again the operation of the driving unit.

According to various embodiments of the disclosure, a set-top box device may include an antenna device including at least one antenna; and a plane lens antenna that is parallel to the antenna device and includes a plurality of unit cells arranged in a predetermined pattern.

According to various embodiments of the disclosure, the set-top box device may further include a housing that accommodates the antenna device and the plane lens antenna and protects the antenna device and the plane lens antenna from an external impact.

According to various embodiments of the disclosure, the housing of the set-top box device may include a wall having a plurality of ribs formed to face the antenna device, and the plane lens antenna may be disposed to correspond to at least some of the plurality of ribs.

According to various embodiments of the disclosure, at least one wall of the housing of the set-top box device may be formed of the plane lens antenna.

According to various embodiments of the disclosure, the plane lens antenna of the set-top box device may be printed on at least one wall of the housing.

While the disclosure has been described in detail with reference to specific embodiments, it is to be understood that various changes and modifications may be made without departing from the scope of the disclosure. Therefore, the scope of the disclosure should not be limited by embodiments described herein, but should be determined by the scope of the appended claims and equivalents thereof.

The invention claimed is:

1. An instrument comprising:

a first plane lens antenna including a plurality of unit cells disposed in a predetermined pattern; and a first support member for allowing the first plane lens antenna to maintain a predetermined distance from an external antenna device including one or more antennas, wherein the first support member is configured to adjust a distance between the external antenna device and the first plane lens antenna in response to a signal requesting a distance adjustment.

2. The instrument of claim 1, wherein the first support member is configured to fix the first plane lens antenna to an outside of a glass wall, and wherein the external antenna device is disposed around an inside of the glass wall, facing the first plane lens antenna.

3. The instrument of claim 1, further comprising:

a first rotary member configured to rotate the first plane lens antenna about a central axis perpendicular to the first plane lens antenna.

4. The instrument of claim 3, wherein the first plane lens antenna is configured such that the unit cells having same dielectric constant are arranged in a linear pattern.

5. The instrument of claim 1, further comprising:

a second plane lens antenna including a plurality of unit cells arranged in a certain pattern different from that of the first plane lens antenna; and a second support member for allowing the second plane lens antenna to maintain a certain distance from the external antenna device.

6. The instrument of claim 5, further comprising:

a second rotary member configured to rotate the first plane lens antenna and the second plane lens antenna about a pole as a central axis to which the instrument is installed.

7. A control method of an electronic device including a plane lens antenna, the method comprising:

receiving, from at least one base station, a first signal strength measurement value of a set-top box device;

comparing the first signal strength measurement value with a pre-stored threshold value;

controlling an operation of a driving unit in case that the first signal strength measurement value is smaller than the pre-stored threshold value; and receiving, from the at least one base station, a second signal strength measurement value of the set-top box device.

8. The method of claim 7, wherein the controlling of the operation includes performing rotation about a pole as a central axis to which the electronic device is installed.

9. The method of claim 7, wherein the controlling of the operation includes adjusting a distance between the set-top box device and the plane lens antenna.

10. The method of claim 7, wherein the controlling of the operation includes rotating the plane lens antenna about a central axis perpendicular to the plane lens antenna.

11. An electronic device comprising:

a plane lens antenna including a plurality of unit cells disposed in a predetermined pattern;

a communication interface configured to communicate with at least one base station;

a driving unit including at least one motor;

a memory storing instructions; and a processor electrically connected to the driving unit, the communication interface, and the memory, wherein the memory stores instructions that cause, when executed, the processor to:

receive a first signal strength measurement value of a set-top box device from the at least one base station by controlling the communication interface, compare the first signal strength measurement value with a pre-stored threshold value, control an operation of a driving unit in case that the first signal strength measurement value is smaller than the pre-stored threshold value, and receive a second signal strength measurement value of the set-top box device from the at least one base station.

12. The electronic device of claim 11, further comprising:

a second plane lens antenna including a plurality of unit cells arranged in a certain pattern different from that of a first plane lens antenna;

a second support member allowing the second plane lens antenna to maintain a certain distance from an external antenna device; and a second rotary member configured to rotate the first plane lens antenna and the second plane lens antenna about a pole as a central axis to which an instrument is installed, wherein the instructions control the second rotary member to rotate the first plane lens antenna and the second plane lens antenna about the pole as the central axis.

13. The electronic device of claim 11, further comprising:

a support member configured to adjust a distance between the set-top box device and a first plane lens antenna, wherein the instructions control the support member to adjust the distance between the set-top box device and the plane lens antenna.

14. The electronic device of claim 11, further comprising:

a first rotary member configured to rotate the plane lens antenna about a central axis perpendicular to the plane lens antenna, wherein the instructions control the first rotary member to rotate the plane lens antenna about the central axis perpendicular to the plane lens antenna.

* * * * *